United States Patent [19]

Transport

[11] 4,291,798

[45] Sep. 29, 1981

[54] DISPLAY DEVICE

[76] Inventor: Felix Transport, 98 Riverside Dr., New York, N.Y. 10024

[21] Appl. No.: 135,539

[22] Filed: Mar. 31, 1980

[51] Int. Cl.[3] ..... B65D 5/52

[52] U.S. Cl. ..... 206/45.24; 248/459; 248/465; 211/40; 40/124.1

[58] Field of Search ..... 206/45.25, 45.26, 45.27; 248/459, 463, 465, 472; 40/124.1; 211/40

[56] References Cited

U.S. PATENT DOCUMENTS

| | | | |
|---|---|---|---|
| 527,694 | 10/1894 | Jones | 40/152.1 X |
| 1,330,946 | 2/1920 | Locke, Jr. | 206/45.25 |
| 1,621,754 | 3/1927 | Rommer | 40/124.1 |
| 1,860,324 | 5/1932 | Eimson | 206/44.12 |
| 2,159,887 | 5/1939 | Darragh | 206/45.25 |
| 2,507,947 | 5/1950 | Williamson | 206/45.27 |
| 2,716,485 | 8/1955 | Hecker | 206/45.25 |
| 2,783,013 | 2/1957 | Williamson | 206/45.25 X |
| 3,013,668 | 12/1961 | Mennen | 211/40 |
| 3,035,363 | 5/1962 | Luchsinger | 40/124.1 |
| 3,130,510 | 8/1964 | Nichols | 40/120 |
| 3,275,281 | 9/1966 | Sampson | 248/465 |
| 3,357,671 | 12/1967 | Ketterer | 248/459 |
| 4,149,630 | 4/1979 | Transport | 206/45.24 |

*Primary Examiner*—Davis T. Moorhead
*Attorney, Agent, or Firm*—James David Jacobs

[57] ABSTRACT

A display device having a collapsible easel support for supporting a display device on a surface at a predetermined angle comprising a back panel having a bottom edge. A stay flap is hinged to the bottom edge of the back panel. A support panel and stay panel are hinged together, the support panel being hinged to the interior of the back panel and the stay panel being hinged to the other edge of the stay flap. The stay panel has a glue flap, which is hinged to the stay flap, and a stay leaf which is hinged to the support panel.

15 Claims, 15 Drawing Figures

DISPLAY DEVICE

BACKGROUND OF THE INVENTION

1. Field of the Invention

The invention relates generally to paper construction, particularly boxes and cartons, and is more specifically directed to a display device having an easel support designed for displaying printed matter or an article of merchandise angled to a surface.

2. Prior Art

In U.S. Pat. No. 4,149,630, issued to the inventor of the present invention, there is disclosed other embodiments of the present invention. In those embodiments a display device having a collapsible easel support is provided which also has a back panel. Hinged to that back panel is a stay flap. A strut is formed by a stay panel hinged to a support panel. The support panel is hinged to the interior of the back panel and the stay panel is hinged to the interior of the stay flap. When deployed, the stay panel rests against the stay flap and the support panel supports the back panel at the predetermined angle to the surface.

In that patent numerous embodiments are disclosed. All of those embodiments are a substantial improvement over the prior art. They provide for display devices automatically manufacturable from a single flat paper blank. The easel supports are of two types. One that is manually deployed and one that is automatically deployed. The manually deployed embodiments require that the individual erecting the collapsible easel support insure that the stay panel properly lays against the stay flap. The other embodiment disclosed in U.S. Pat. No. 4,149,630 automatically erects the easel support.

Discussed fully in U.S. Pat. No. 4,149,630 is other relevant art. As shown there, the prior art utilizes easel supports which easily tend to collapse or are extremely complex and difficult to erect. Illustrative of the first type is U.S. Pat. No. 3,357,671 and illustrative of the second type are U.S. Pat. Nos. 2,507,947; 2,783,013 and 1,860,324. Other prior art of interest are U.S. Pat. Nos. 1,860,324; 1,330,946; 527,694; Re 22,109; 1,621,754; 2,159,887; 2,716,485; 3,013,668; 3,035,363; and 3,130,510; and British Pat. No. 113,330.

Accordingly, it is an object of the present invention to provide a display device having an easel support for a display device which can be made from a unitary blank.

It is another object of the present invention to provide for such display device which can be quickly and easily assembled.

It is another object of the present invention to provide for such a display device.

It is another object of the present invention to provide such a display device which is collapsible and occupies relatively little additional room in a collapsed state than the assembled box or card for which it provides support.

It is another object of the present invention to provide such a display device which does not require careful attention to deployment.

It is another object of the present invention to provide such a display device which does not require intricate assembly for deployment.

It is another object of the present invention to provide an easel support which can be automatically manufactured without manual assembly by machine die cutting, scoring, glueing and other such techniques.

It is another object of the present invention to provide for such a display device that permits the blanks be closely abutted to each other to make efficient use of the paper from which they are cut.

It is another object of the present invention to provide for the above objects in a simple, clean, attractive, and relatively inexpensive construction.

SUMMARY OF THE INVENTION

In accordance with the preferred embodiment of the present invention, the above and other objects are obtained by a collapsible easel support for supporting a display on a surface at an angle that comprises a back panel having a bottom edge. Also provided is a stay flap and a support panel having top and bottom edges. A stay panel includes a glue flap hinged to a stay leaf. The other end of the glue flap is hinged to the bottom edge of said stay panel and the other edge of the stay leaf is hinged to the support panel. When assembled, the glue flap is permanently attached along its co planer surface to said stay flap. The stay leaf also lies against the glue panel and the support panel supports the back panel at an angle to said surface.

DESCRIPTION OF THE DRAWINGS

A more complex appreciation of the invention and any of the attendant features thereof will be readily apparent by reference to the following description when considered in connection with the accompanying drawings.

Figure 4:
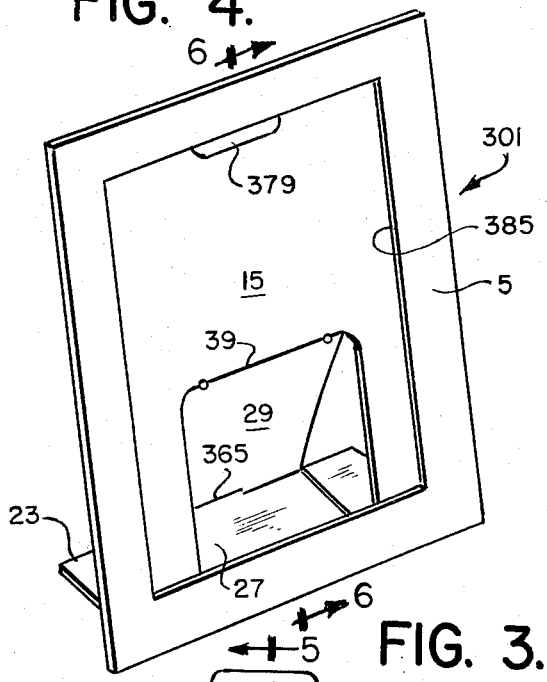
FIG. 4 is a front perspective view of a display card of FIG. 1.
Figure 2:
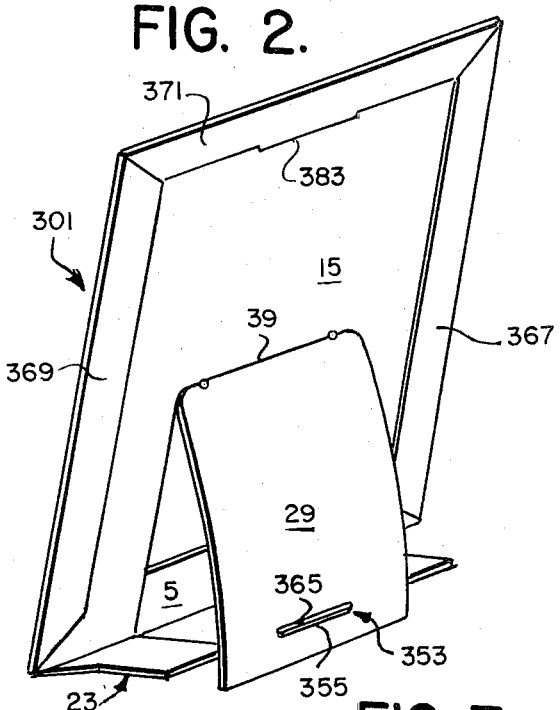
FIG. 2 is a rear perspective view of the display card of FIG. 1 when fully erected.
Figure 3:
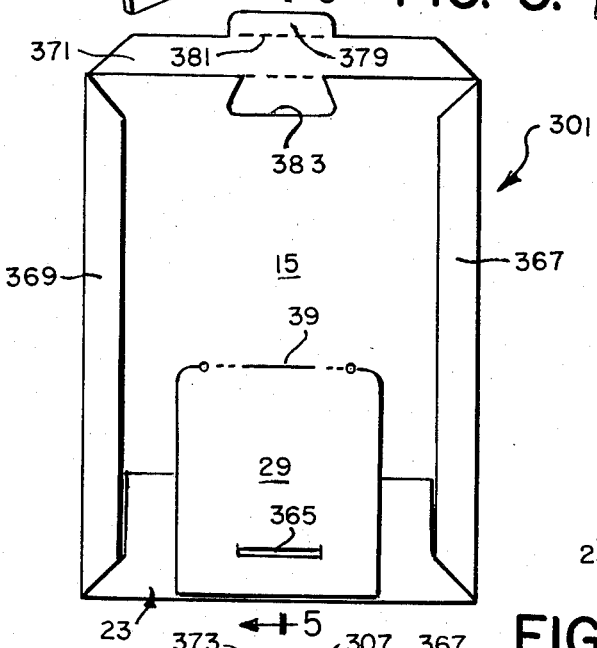
FIG. 3 is a rear elevational view of the display card of FIG. 1 in its collapsed state.

The present invention will be best understood from consideration of the following detailed description taken in connection with the above-described drawings.

However, one skilled in the art will recognize that the invention is not confined to the embodiment and variation shown and described.

DESCRIPTION OF THE INVENTION

Referring now to the drawings, FIGS. 1–8, wherein for purposes of comparison with U.S. Pat. No. 4,149,630 like reference numbers sometimes designate corresponding parts in the embodiments disclosed in that patent and this specification. However, as one skilled in the art will recognize, these like reference numbers are not used by way of limitation, but for illustration and explanation.

Display card 301 comprises a front panel 5 and a back panel 15. Front panel 5 has side edges 307 and 309. It also has top edges 311 and bottom edge 313. Back panel 15 has side edges 315 and 317, top edge 319 and bottom edge 321.

A stay flap 23 joins front panel 5 and back panel 15. A front hinge 325 joins stay flap 23 to bottom edge 313 of front panel 5. Similarly, a back hinge 327 (similar to score 27 in U.S. Pat. No. 4,149,630) joins stay flap 23 to bottom edge 321 of back panel 15.

A dividing score 329 in stay flap 23 is substantially parallel to bottom edges 313 and 321. Also dividing score 329 in the preferred embodiment divides stay flap 23 into a front stay flap 331 and a back stay flap 333.

Two slits 31 and 33, which are substantially parallel to each other and substantially perpendicular to bottom edges 313 and 321, extend from the interior of back panel 15 substantially to dividing score 329. A first score 39 in back panel 15 is substantially parallel to bottom edges 313 and 321 and extends between slits 31 and 33. In the preferred embodiment holes 341 and 343 are cut at the intersection of first score 39 with slits 31 and 33, respectively. As one skilled in the art will recognize, holes 341 and 343 protect both the score and the remainder of the card from accidental extension of slits 31 and 33 through mishandling.

An operating score 345 in stay flap 23 between dividing score 329 and bottom edge 321 is substantially parallel to bottom edge 321 and extends between slits 31 and 33. A third score 37 is parallel to and between operating score 345 and first score 39. In the preferred embodiment third score 37 is colinear with back hinge 327.

First score 39 and third score 37 define a support panel 29 between slits 31 and 33. Between dividing score 329 and third score 37 there is defined a stay panel 27 between slits 31 and 35. Glue flap 351 is defined in stay panel 27 between operating score 345 and dividing score 329 between slits 31 and 35 and a stay leaf 349 is defined in stay panel 27 between operating score 345 and third score 37. As will become more fully understood after a reading of the operation below, glue flap 351 is glued to front stay flap 331 when display card 301 is assembled.

A locking mechanism 353 is also provided. Locking mechanism 353 comprises a tongue 355 hinged to glue flap 351 by hinge 357. Tongue 355 is defined by parallel slits 359 and 361, which are perpendicular to dividing score 329 and extend into front stay flap 331, and by slit 363, which is parallel to dividing score 329 and runs between slits 359 and 361.

Figure 6:
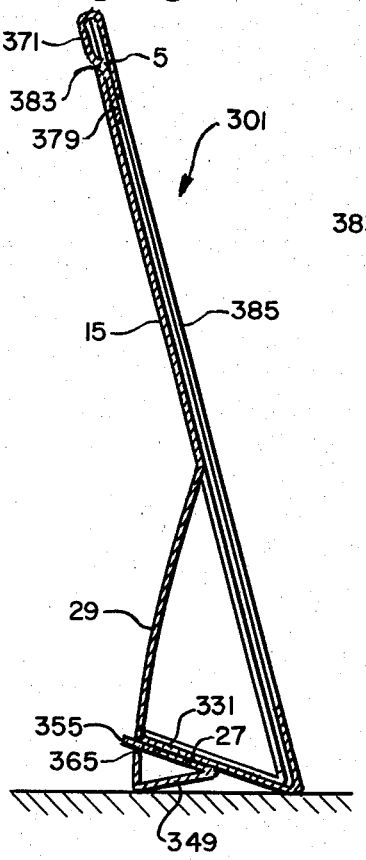
FIG. 6 is a cross-sectional view of the display card of FIG. 1 when fully erected.
Figure 5:
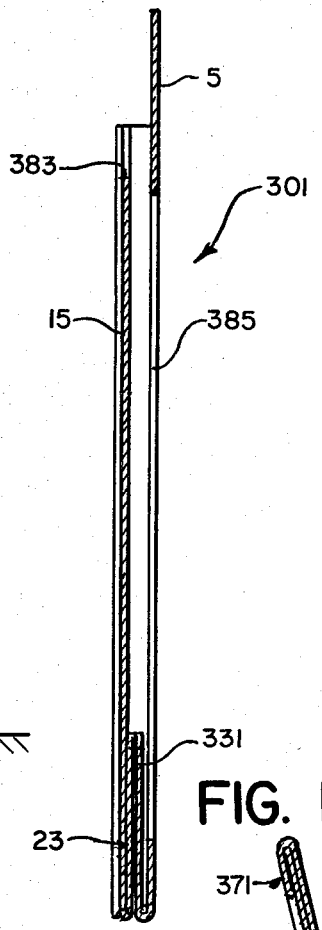
FIG. 5 is a side cross-sectional view of the display card of FIG. 3 in its collapsed state.

In its erected state tongue 355 engages locking slit 365 in support panel 29. As seen in FIG. 6 locking slit 365 is substantially parallel to third score 37 and some distance removed therefrom. Locking slit 365 is disposed above third score 37. This provides for a substantially triangular easel support formed between stay flap 23, support panel 29 and back panel 15.

Also provided in this embodiment are means for locking the front panel 5 to back panel 15. These comprise flange 367 along side edge 307, flange 369 along side edges 309 and flange 371 along top edge 311. Flanges 367, 369 and 377 are hinged to front panel 5 by hinges 373, 375 and 377. In the assembled state glue is applied to flanges 367 and 369 and those flanges are bent along hinges 373 and 375, respectively, to engage back panel 15 as can clearly be seen from FIGS. 1 through 3.

Flange 371 is designed to be selectively engaged and disengaged from back panel 15. In the preferred embodiment these means are provided by a tongue 379, which is hinged to hinge 371 by hinge 381. Tongue 379 engages trapzoidal slot 383 cut into top of back panel 15.

Figure 7:
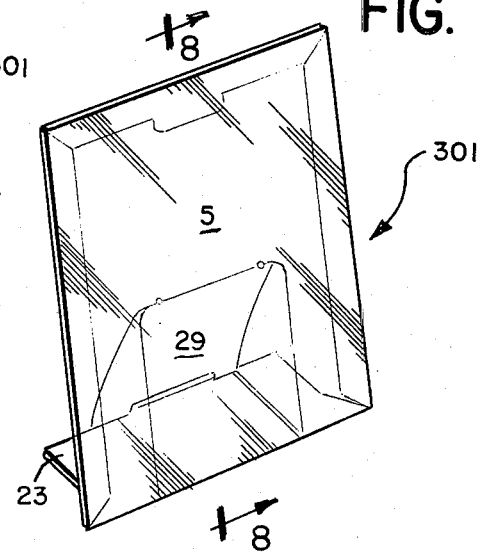
FIG. 7 is a front perspective view of the display card of FIG. 1 made from a transparent material.
Figure 1:
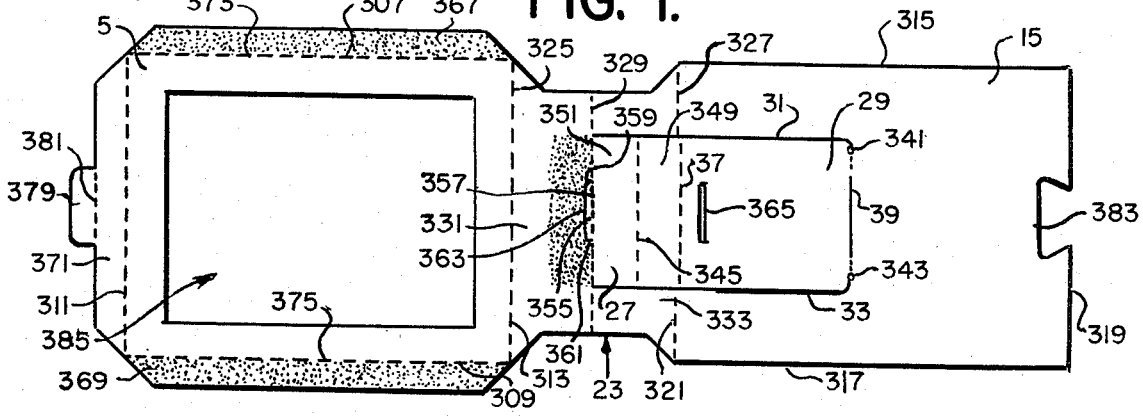
FIG. 1 is a plan elevational view of the blank of the display card after die cutting and scoring but prior to folding and glueing.
Figure 8:
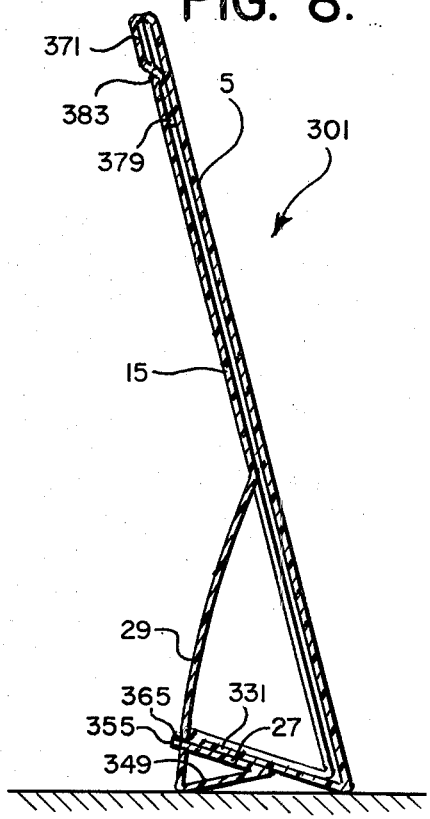
FIG. 8 is a side cross-sectional view of the display card of FIG. 7 when fully erected.
Figure 10:
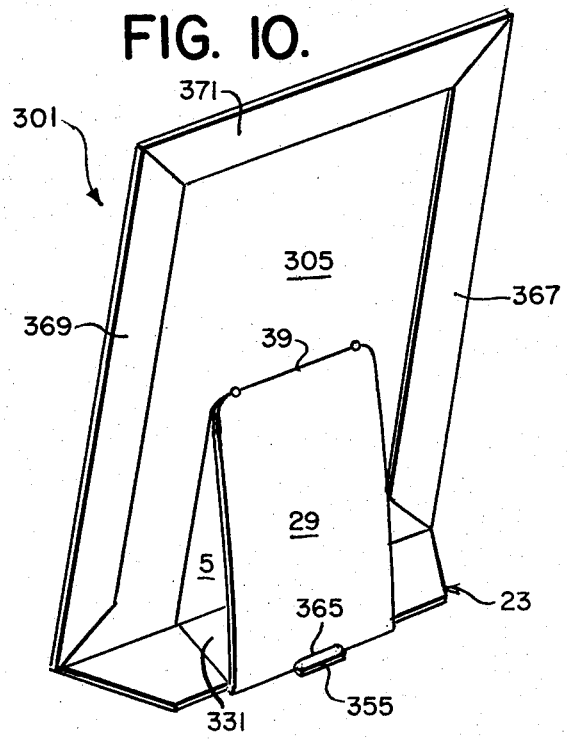
FIG. 10 is a rear perspective view of the display card of FIG. 9.
Figure 11:
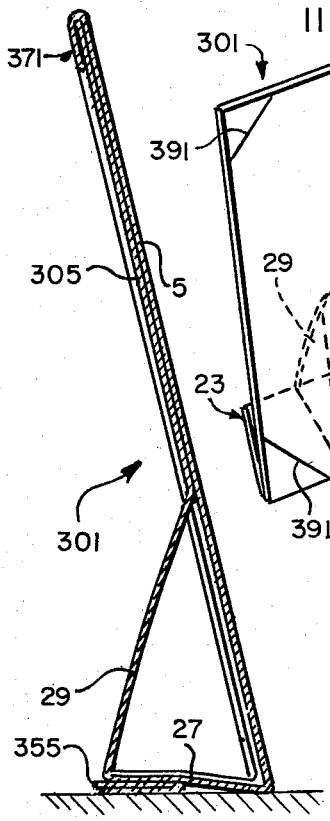
FIG. 11 is a cross-sectional view of the display card of FIG. 9.

FIGS. 7 and 8 illustrate a variation of the embodiment of FIG. 1. Rather than having a rectangular aperture 385 in front panel 5 as shown, in FIGS. 7 and 8 front panel 5 is solid. However, the entire display card 301 is made from a transparent or semi-transparent material, such as plastic, which can be cut and folded similar to papers.

OPERATION OF FIGS. 1 THROUGH 8

Display card 301 is assembled from the blank illustrated in FIG. 1 by first applying glue to flanges 367 and 369 and to the portion of front stay flap 331 which will contact glue flap 351 (i.e., the shaded portions in FIG. 1). Back panel 15 is then folded against front panel 5. Flange 367 is bent along hinge 373 and applied against back panel 15. Similarly, flange 369 is bent along hinge 373 and applied against back panel 15.

Front stay flap 331 and back stay flap 333 are bent along front hinge 325 and back hinge 327 towards back panel 15. Simultaneously, stay panel 349 is bent along dividing score 329 towards front stay flap 331 until it lays against front stay flap 331. Glue flap 351 is permanently glued to front stay flap 331. At this point the assembled display card 301 is as it appears in FIG. 3.

To deploy display card 301 all one needs to do is to rotate stay flap 23 away from back panel 15 around hinge 325 and 327. As stay flap 23 is rotated the edge of stay flap 23 defined by dividing score 329 pushes support panel 29 away from back panel 15. Eventually, locking tongue 355 will engage locking slit 365 and the collapsible easel support of this embodiment will be fully deployed as in FIGS. 1 and 2.

One then can insert between front panel 5 and back panel 15 any card, photograph, etc. which will either be visable through the rectangular aperature 381 in front panel 303 or through its transparent face, depending on embodiment. The insert can then be locked between front panel 5 and back panel 15 by bending flange 371 along hinge 377 and engaging tongue 379 in trapezoidal slot 383 locking flange 371 against back panel 305.

OPERATION AND DESCRIPTION OF FIGS. 9 THROUGH 12

In FIGS. 9–12 there is illustrated another embodiment of the present invention which is a variation of the display card illustrated in FIGS. 1–8. In this variation locking slit 365 is colinear with back hinge 327. Accordingly, in the deployed position display card 301 illustrated in FIG. 11 has its stay panel 27 disposed against glue flap 351. Also, the embodiment of FIGS. 9–12 has flange 371 glued to back panel 305.

Figure 9:
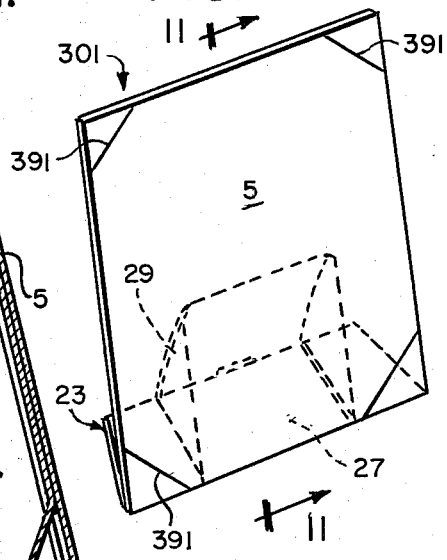
FIG. 9 is a front perspective view of another embodiment of a display card having an automatically deployable collapsible easel support.
Figure 12:
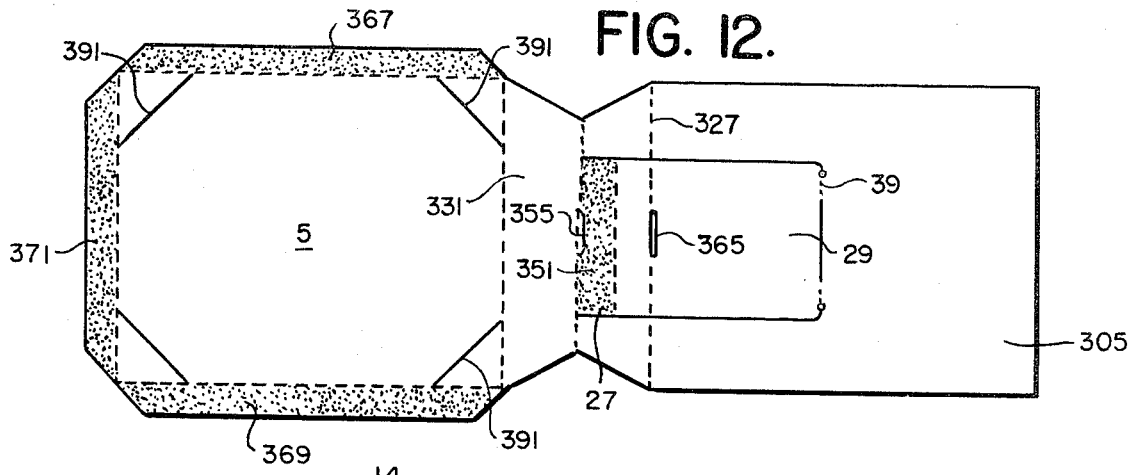
FIG. 12 is a plan elevational view of the display card of FIG. 9.

Also, shown in FIGS. 9 and 12 are diagonal slits 391 at the corners of front panel 5. As one skilled in the art will recognize the corners of a photograph or other pre-prepared display card can be slipped through diagonal slits 391 to affix that photograph or card to front panel 5.

Other than these variations the embodiment of FIGS. 9–12 is identical to the embodiment shown in FIGS. 1–8, both in design and operation.

DESCRIPTION OF FIGS. 13 THROUGH 15

Figure 13:
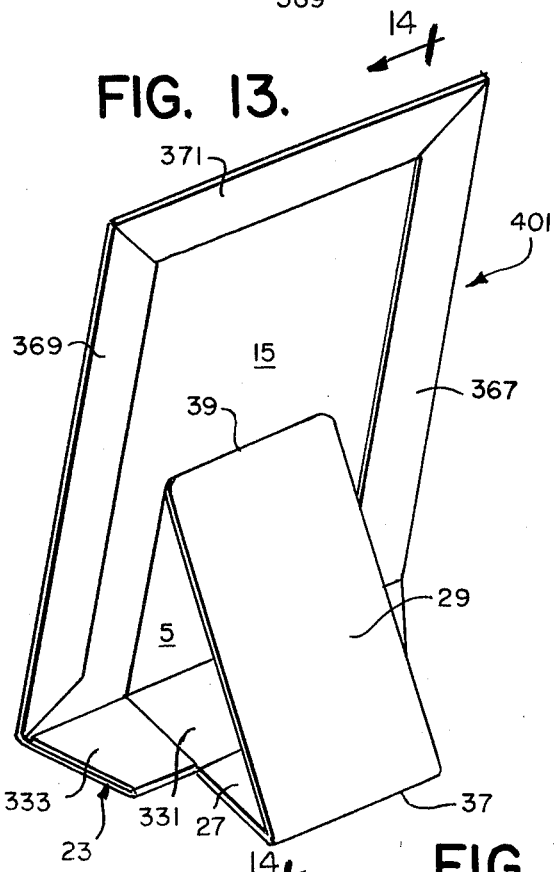
FIG. 13 is a rear elevational view of another embodiment of the display card having an automatically deployable collapsible easel support.
Figure 14:
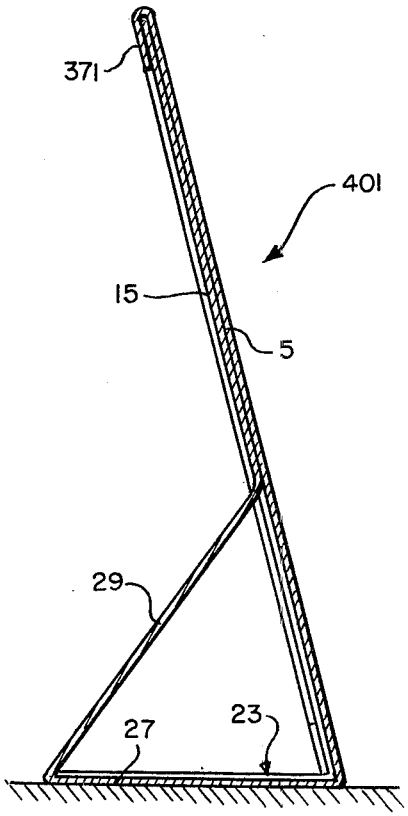
FIG. 14 is a side cross-sectional view of the display card of FIG. 13.
Figure 15:
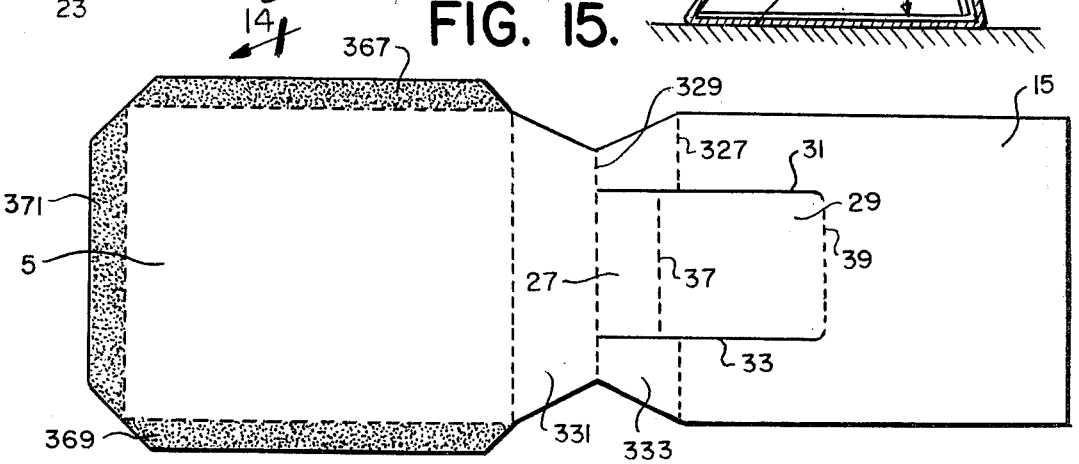
FIG. 15 is a plan elevational view of the display card of FIG. 13.

Referring to FIGS. 13–15 one skilled in the art will easily understand the design and operation of display card 401 from the previous description of the embodiments above. This embodiment will deploy semi-automatically. In this embodiment, as in the prior embodiments, there is a front panel 5, a back panel 15, a front stay flap 331 and a back stay flap 333. Separating front stay flap 331 and back stay flap 333 is dividing score 329. Also present are slits 31 and 33 extending from dividing score 329 into back panel 5. A support panel 29 is defined between slits 31 and 33, first score 39 in back panel 15 and a third score 37, which is substantially parallel to first score 39 and extends between slits 31 and 33. As will be noted from FIGS. 13–15, and in particular FIG. 15, in this embodiment third score 37 is located between back hinge 327 and dividing score 329. Stay panel 27 is formed between third score 37 and dividing score 329.

OPERATION OF FIGS. 13 THROUGH 15

As with the prior two embodiments in an assembled position the embodiment of FIGS. 13–15 has back panel 15 and front panel 5 folded against each other. Flanges 369, 371 and 373 are folded and glued against the back panel 15.

In deploying the display card 401 of FIGS. 13–15, stay 23 (combined front stay flap 331 and back stay flap 333) is moved toward back panel 15. Significantly, this movement can be caused by merely bringing the edge of stay flap 23 into contact with the table surface when card 401 is substantially perpendicular to the surface. Continued downward pressure causes the stay panel 27 to assume an attitude substantially colinear with stay flap 23 and at an acute angle to support panel 29. As shown in FIGS. 13 and 14 in the fully deployed position the combination of support panel 29 at the acute angle to stay panel 27 and stay flap 23 supports display card 401 at an angle to the supporting surface under the weight of display card 401.

While the invention has been described by specific embodiments in illustrated variations, it is not limited thereto. Obvious modifications will incur to those skilled in the art. For example, various other methods of fastening back panel 15 to front panel 5 can be envisioned. Similarly, rather than merely using a card or a frame, one skilled in the art could use the present invention with regard to any display device, such as a box, leaflet holder, etc. Similarly, rather than using full-length score lines for hinges as in the preferred embodiments, one skilled in the art could use other methods such as tape.

Thus, one skilled in the art could create various modifications without departing from the scope of this invention as defined by the following claims.

What is claimed is:

1. A display device having a collapsible easel support for supporting a display device on a surface at a predetermined angle comprising:
- a back panel having a bottom edge;
- a stay flap;
- a support panel having top and bottom edges;
- a stay panel including:
  - a glue panel having top and bottom edges;
  - a stay leaf having top and bottom edges;
  - a hinge connecting the bottom edge of said stay leaf to the top edge of said glue panel;
- a first hinge hinging said stay flap to said bottom edge of said back panel;
- a second hinge hinging the bottom edge of said support panel to the top edge of said stay leaf;
- a third hinge hinging the top edge of said support panel to the interior of said back panel;
- a fourth hinge hinging the bottom edge of said glue panel to said stay flap.

2. A display device having a collapsible easel support for supporting a display device on a surface at a predetermined angle comprising:
- a back panel having a bottom edge;
- a stay flap having top and bottom edges;
- a support panel having top and bottom edges;
- a stay panel having top and bottom edges;
- a first hinge hinging the top edge of said stay flap to said bottom edge of said back panel;
- a second hinge hinging the bottom edge of said support panel to the top edge of said stay panel;
- a third hinge hinging the top edge of said support panel to the interior of said back panel;
- a fourth hinge hinging the bottom edge of said stay panel to the bottom edge of said stay flap;
- said stay flap and said stay panel in substantially coplanar relationship when said display device has its easel fully erected and said support panel supporting said back panel at the predetermined angle to said surface.

3. A display card having an automatically deployable collapsible easel support for supporting said display card on a surface at a predetermined angle comprising:
- a front panel having two side edges, a top edge and a bottom edge;
- a back panel having two side edges, a top edge and a bottom edge;
- a stay flap;
- a front hinge hinging said stay flap to the bottom edge of said front panel;
- a bottom hinge hinging said stay flap to said bottom edge of said back panel;
- a dividing score in said stay flap parallel to the bottom edge of said front panel and said back panel dividing said stay flap with a front stay flap and a back stay flap;
- two substantially parallel slits substantially perpendicular to said bottom edges extending from the interior of said back panel to substantially said dividing score;
- a first score in said back panel substantially parallel to said bottom edge and extending between said two slits;
- a second score in said stay flap between said dividing score and said bottom edge substantially parallel to said bottom edge and extending between said two slits;
- a third score colinear with said back hinge and extending between said two slits;

said first score and said third score defining a support panel, said dividing score and said third score defining a stay panel, said second score and said dividing score defining a glue flap in said stay panel, and said second score and said third score defining a stay leaf;

said front panel disposed against said back panel with said bottom edges substantially colinear and adjacent and said front stay flap and said back stay flap disposed against each other, said glue flap disposed against said stay panel, and said back stay panel and said support panel supporting said front and back panels at the predetermined angle to the surface.

4. A display card as in claim 3 wherein said dividing score divides said stay flap substantially in half.

5. A display card as in claim 3 wherein said display card is made of transparent material.

6. A display card as in claim 3 including:

locking means for locking said collapsible easel support in its deployed position.

7. A display card as in claim 6 wherein said locking mechanism comprises:

a tongue hinged to said stay flap;

a slit in said support panel;

said tongue engaging said slit to lock said stay flap at a predetermined angle with respect to said support panel.

8. A display card as in claim 7 wherein said slit is on said third score.

9. A display card as in claim 3 including an aperature in said front panel.

10. A display card as in claim 3 made from a single contiguous sheet.

11. A display card as in claim 3 wherein said front panel includes:

flanges hinged to the two side edges and top edge, said flanges engaging said back panel.

12. A display card as in claim 11 wherein said flange hinged to the top edge of said front panel includes means to detachably engage said back panel.

13. A display card having a collapsible support for supporting said display card on a surface at a predetermined angle comprising:

a front panel having two side edges, a top edge and a bottom edge;

a back panel having two side edges, a top edge and a bottom edge;

a stay flap;

a back hinge hinging said stay flap to said bottom edge of said back panel;

a dividing score in said stay flap parallel to the bottom edge of said front panel and said back panel, dividing said stay flap into a front stay flap and a back stay flap;

two substantially parallel slits substantially perpendicular to said bottom edges extending from the interior of said back panel to substantially said dividing score;

a first score in said back panel substantially parallel to said bottom edge and extending between said two slits;

a second score in said stay flap between said dividing score and said back hinge substantially parallel to said back hinge and extending between said two slits;

said first score and said second score defining a support panel edge and said second score and said dividing score defining a stay panel, said stay panel and said stay flap substantially coplanar, and said support panel supporting said front and back panels at the predetermined angle to the surface.

14. A self-supporting display device comprising a sheet of material folded upon itself to provide joined front and rear panels including:

a hinge dividing said front and rear panels;

front and rear fold lines on both sides of said hinge providing bottom panels, said bottom panels being secured together to provide a base panel;

parallel slits extending from intermediate said rear panel to approximately said hinge forming an extensible support member;

a first score line extending between approximately the top of said slits;

a second score line between said parallel slits extending substantially centrally of said rear fold line;

a third score line extending between said parallel slits substantially centrally of said hinge whereby when said base panel is moved in an accurate direction the extensible support member will move outwardly to provide a base and a diagonally disposed support which are offset from each other along said second score line.

15. A self-supporting display device comprising a sheet of material folded upon itself to provide joined front and rear panels including:

a hinge dividing said front and rear panels;

front and rear fold lines on both sides of said hinge providing bottom panels, said bottom panels being secured together to provide a base panel;

parallel slits extending from intermediate said rear panel to approximately said hinge forming an extensible support member;

a first score line extending between approximately the top of said slits;

a second score line between said parallel slits extending substantially centrally of said rear fold line;

a third score line extending between said parallel slits substantially centrally of said hinge;

a fourth score line extending between said second and third score lines to provide first and second additional panels;

said first additional panel being folded under said base panel and secured thereto whereby when said base panel is moved in an arcuate direction, the extensible support member will move outwardly to provide a base, comprising said base panel and said second additional panel, and a diagonally disposed support member, which are offset from each other along said second score line.

* * * * *